US011382479B2

(12) United States Patent
Moeller et al.

(10) Patent No.: US 11,382,479 B2
(45) Date of Patent: Jul. 12, 2022

(54) FLOOR CLEANING MACHINE

(71) Applicant: MILWAUKEE ELECTRIC TOOL CORPORATION, Brookfield, WI (US)

(72) Inventors: Scott T. Moeller, Richfield, WI (US); Michael A. Verhagen, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 618 days.

(21) Appl. No.: 16/191,917

(22) Filed: Nov. 15, 2018

(65) Prior Publication Data

US 2019/0150693 A1 May 23, 2019

Related U.S. Application Data

(60) Provisional application No. 62/587,641, filed on Nov. 17, 2017.

(51) Int. Cl.

| | |
|---|---|
| ***A47L 11/40*** | (2006.01) |
| ***A47L 9/04*** | (2006.01) |
| ***A47L 11/24*** | (2006.01) |

(52) U.S. Cl.

CPC ..... *A47L 11/4038* (2013.01); *A47L 9/0477* (2013.01); *A47L 11/24* (2013.01); *A47L 11/4013* (2013.01); *A47L 11/4041* (2013.01)

(58) Field of Classification Search

CPC .... A47L 11/4038; A47L 9/0477; A47L 11/24; A47L 11/4013; A47L 11/4041; A47L 5/30; A47L 9/0411; A47L 9/04; A47L 5/03; A47L 11/29; A47L 11/30; A47L 11/40; A47L 9/02; A47L 5/34

See application file for complete search history.

(56) References Cited

U.S. PATENT DOCUMENTS 3,937,174 A * 2/1976 Haaga ..... A47L 11/22 15/42
4,071,920 A * 2/1978 Block ..... A47L 11/22 15/52.1

(Continued)

FOREIGN PATENT DOCUMENTS

DE 2845212 A1 10/1979

OTHER PUBLICATIONS

Invitation to Pay Additional Fees for International Application No. PCT/US2018/061249 dated Feb. 7, 2019, 14 pages.

*Primary Examiner* — Robert J Scruggs
(74) *Attorney, Agent, or Firm* — Michael Best & Friedrich LLP

(57) ABSTRACT

A floor cleaning machine includes a housing having a front end and a rear end, and a rotary brush coupled to the housing for rotation with respect to the housing. A collection bin is configured to receive debris from the rotary brush and a debris intake is in fluid communication with the collection bin. A motor rotates the rotary brush, and a power source supplies power to the motor. A suction source is in fluid communication with the collection bin to draw debris into the debris intake and to direct the debris into the collection bin. A projection is positioned adjacent the rotary brush and the debris intake engage bristles of the rotary brush to dislodge debris from the bristles, so that the suction source is configured to draw debris dislodged from the bristles of the rotary brush into the debris intake.

20 Claims, 12 Drawing Sheets

(56) References Cited

U.S. PATENT DOCUMENTS

| | | | | |
|---|---|---|---|---|
| 7,152,275 | B2 * | 12/2006 | Hitzelberger | A47L 5/28 15/352 |
| 10,022,027 | B2 * | 7/2018 | Conrad | A47L 9/2878 |
| 2007/0157415 | A1 * | 7/2007 | Lee | A47L 9/2884 15/319 |
| 2007/0157420 | A1 * | 7/2007 | Lee | A47L 5/225 15/328 |
| 2010/0313912 | A1 * | 12/2010 | Han | A47L 11/33 134/21 |
| 2013/0025085 | A1 * | 1/2013 | Kim | A47L 9/2857 15/319 |
| 2013/0056026 | A1 * | 3/2013 | Jung | A47L 9/0411 134/6 |

* cited by examiner

FLOOR CLEANING MACHINE

CROSS-REFERENCE TO RELATED APPLICATIONS

This application claims priority to U.S. Provisional Patent Application No. 62/587,641, filed Nov. 17, 2017, the entire contents of which are hereby incorporated by reference herein.

BACKGROUND

The present invention relates to floor cleaning machines, and particularly to powered floor sweepers.

SUMMARY

The invention provides, in one aspect, a floor cleaning machine including a rotary brush rotatable about a first axis and a brushroll rotatable about a second axis. The brush and the brushroll are configured to convey debris toward a collection bin. The floor cleaning machine also includes a suction source configured to produce a first suction zone between the brush and the brushroll and a second suction zone in the collection bin. In some embodiments, the brush, the brushroll, and the suction source are powered by a rechargeable power tool battery pack.

In some embodiments, the invention provides a floor cleaning machine including a housing having a front end and a rear end, and a rotary brush coupled to the housing for rotation with respect to the housing. A collection bin is configured to receive debris from the rotary brush and a debris intake is in fluid communication with the collection bin. A motor rotates the rotary brush, and a power source supplies power to the motor. A suction source is in fluid communication with the collection bin to draw debris into the debris intake and to direct the debris into the collection bin. A projection is positioned adjacent the rotary brush and the debris intake engage bristles of the rotary brush to dislodge debris from the bristles, so that the suction source is configured to draw debris dislodged from the bristles of the rotary brush into the debris intake.

In some embodiments, the invention provides a floor cleaning machine including a housing having a front end and a rear end and a wheel coupled to the housing to facilitate moving the machine along a surface to be cleaned. A rotary brush is coupled to the housing for rotation with respect to the housing, and a collection bin is configured to receive debris from the rotary brush. The collection bin includes a front wall positioned between the front end of the housing and the rear end of the housing, the front wall defining an entry opening, a rear wall positioned adjacent the rear end of the housing, and an upper wall extending between the front wall and the rear wall. The upper wall is oriented at an oblique angle with respect to the surface being cleaned, such that a cross-sectional area of the collection bin increases in a direction from the entry opening in the front wall toward the rear wall. A debris intake is in fluid communication with the entry opening in the front wall of the collection bin. A motor rotates the rotary brush, and a power source supplies power to the motor. A suction source is configured to draw debris into the debris intake and direct the debris into the collection bin, such that debris directed into the entry opening in the front wall of the collection bin is directed along the oblique upper wall toward the rear wall.

In some embodiments, the invention provides a floor cleaning machine including a housing having a front end and a rear end, and a rotary brush coupled to the housing for rotation with respect to the housing. A collection bin receives debris from the rotary brush, and a debris intake is in fluid communication with the collection bin. A motor rotates the rotary brush, and a power source supplies power to the motor. A first suction source draws air and debris through the debris intake. A second suction source draws air from the collection bin to create a negative pressure in the collection bin to move the debris drawn through the debris intake by the first suction source into the collection bin in response to the negative pressure in the collection bin created by the second suction source.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
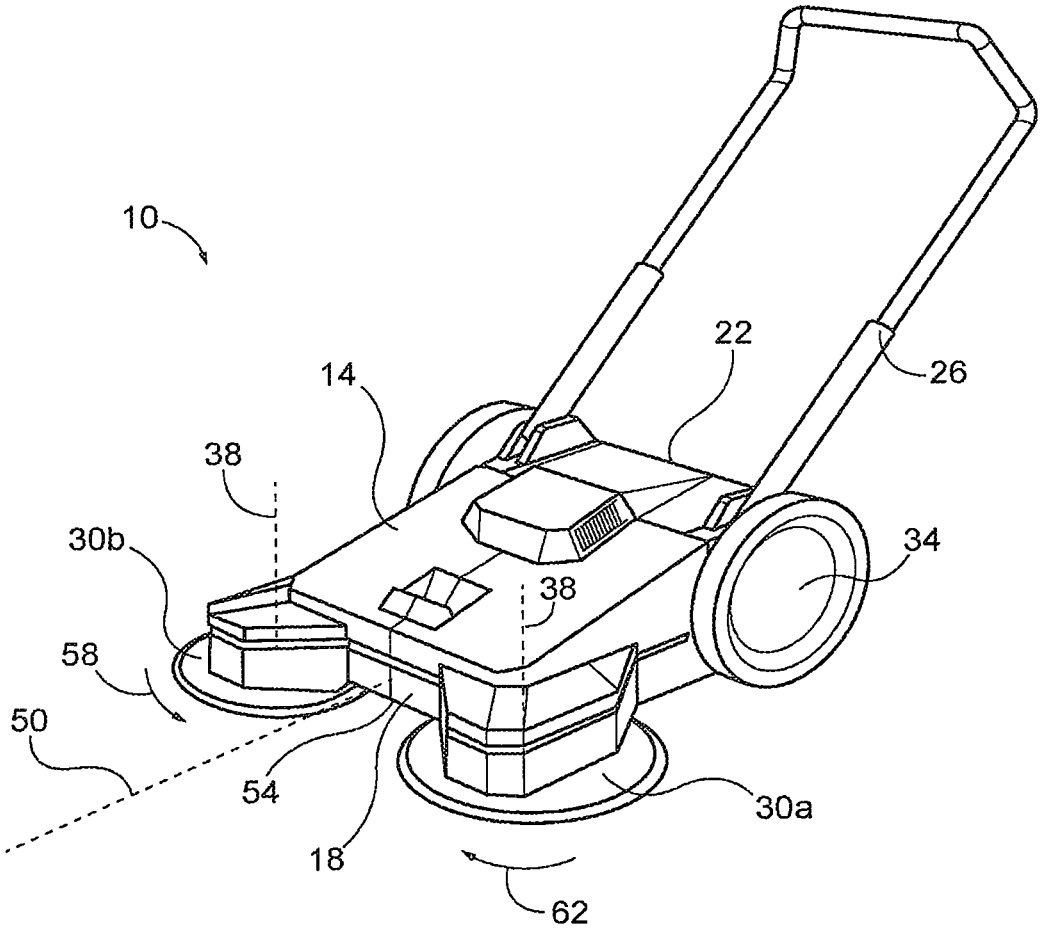
FIG. 1 a perspective view of a floor cleaning machine according to one embodiment of the invention.

FIG. 1 illustrates a floor cleaning machine 10 or floor sweeper according to an embodiment of the invention. The machine includes a housing 14 having a front end 18, a rear end 22, a handle 26 pivotally coupled to the housing 14 proximate the rear end, and first and second rotary brushes 30*a*, 30*b* coupled to the housing 14 proximate the front end 18. A pair of ground engaging wheels 34 are coupled to the housing 14 proximate the rear end 22 to facilitate moving the machine 10 along a surface to be cleaned (see surface 36 in FIG. 2).

Figure 2:
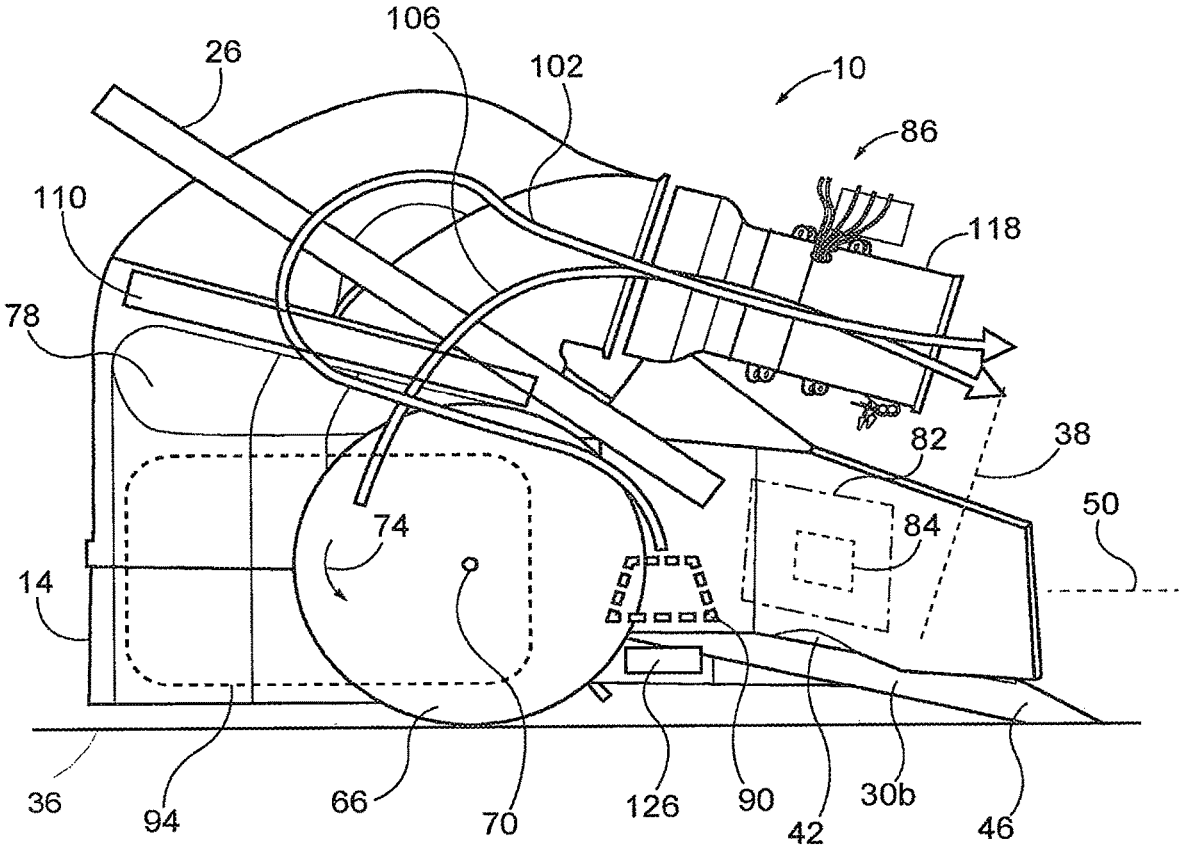
FIG. 2 is a cross-sectional view of the floor cleaning machine of FIG. 1, with portions of a housing of the floor cleaning machine hidden.

Each of the brushes 30*a*, 30*b* is rotatable about a brush axis 38 and includes a hub 42 (FIG. 2) and a plurality of bristles 46 extending outward from the hub 42. The bristles 46 extend from the hub at a downward angle such that the brushes 30*a*, 30*b* are generally bowl-shaped. The brushes 30*a*, 30*b* are configured to rotate in opposite directions to convey dirt and debris generally inward, toward a longitudinal axis 50 of the machine 10 that extends through the center of the housing 14 and through the front and rear ends 18, 22, and rearward, toward an inlet 54 in the front end 18 of the housing 14 (FIG. 1). For example, the second rotary brush 30*b* on the right hand side of the machine 10 rotates about its brush axis 38 in direction 58, and the first rotary brush 30*a* on the left hand side of the machine 10 rotates about its brush axis 38 in direction 62. The brush axes 38 may be oriented vertically (i.e. perpendicular to the surface being cleaned 36). In other embodiments, the brush axes 38 may be oblique with respect to the surface being cleaned 36. For example, the brush axes 38 of FIG. 2 are inclined forward with respect to the surface being cleaned 36. In some embodiments, the orientation of the brush axes 38 may be adjustable by a user of the machine 10. In some embodiments, the height of each of the brushes 30*a*, 30*b* may be adjustable.

With reference to FIG. 2, the machine 10 further includes a brushroll 66 rotatably supported by the housing 14 at a position rearward of the brushes 30*a*, 30*b*. The brushroll 66 defines a rotational axis 70 that is generally transverse to the longitudinal axis 50 of the housing 14. The brushroll 66 is rotatable in direction 74 to sweep dust and debris upward and rearward into a collection bin 78 located within the housing 14 behind the brushroll 66. The brushroll 66 and the rotary brushes 30*a*, 30*b* are driven by a drive assembly 82 that includes at least one electric motor 84. In the illustrated embodiment, the brushroll 66 can be driven at a maximum rotational speed greater than 440 RPM. For example, in some embodiments, the brushroll 66 can be driven at a maximum rotational speed of 700 RPM. The high brushroll speed advantageously removes more dust and debris from the surface being cleaned than is possible at lower speeds.

The motor 84 of the drive assembly 82 may be any type of electric motor but is preferably a DC electric motor, such as a brushed DC motor or a brushless DC motor. The motor 84 can be coupled to the brushroll 66 and the rotary brushes 30*a*, 30*b* via one or more belts, pulleys, gears, and the like. In some embodiments, the drive assembly 82 may include multiple motors. For example, in one embodiment (not shown), the drive assembly 82 includes a first motor coupled to the brushroll 66 and a second motor coupled to the rotary brushes 30*a*, 30*b*. This allows the brushroll 66 and the rotary brushes 30*a*, 30*b* to be controlled independently. In another embodiment (not shown), the drive assembly 82 includes a first motor coupled to the brushroll 66, a second motor coupled to one rotary brush 30*a*, and a third motor coupled to the other rotary brush 30*b*. This allows the brushroll 66 and each of the rotary brushes 30*a*, 30*b* to be controlled independently. In some embodiments, the motors may directly drive the rotary brushes 30*a*, 30*b* and/or the brushroll 66.

In some embodiments, the brushroll 66 and the rotary brushes 30*a*, 30*b* may also be drivably coupled to the wheels 34. For example, the machine 10 may be operable in a manual or unpowered mode in which the brushroll 66 and the rotary brushes 30*a*, 30*b* are driven in response to rotation of the wheels 34, as a user pushes the machine 10 along a surface. In some embodiments, the rotary brushes 30*a*, 30*b* may be drivably coupled to other ground-engaging wheels, such as castors (not shown) extending downward from the respective hubs 42.

Referring to FIG. 2, the illustrated machine 10 includes a suction source 86 that generates a suction airflow at a first suction zone 90 and a second suction zone 94 (FIG. 2). The first suction zone 90 is located proximate a leading edge of the brushroll 66 and generally between the brushroll 66 and the rotary brushes 30*a*, 30*b*. The second suction zone 94 is located in the collection bin 78 to produce negative pressure within the collection bin 78. The suction source 86 is fluidly coupled to the first suction zone 90 via a first flow path 102, and the suction source 86 is fluidly coupled to the second suction zone 94 via a second flow path 106. The first flow path 102 and the second flow path 106 each extend through a filter 110 (e.g., a pleated filter), located between the suction zones 90, 94 and the suction source 86. In the illustrated embodiment, the filter 110 is located above the collection bin 78; however, the filter can be located elsewhere. In some embodiments, the suction source 86 can generate a maximum combined airflow rate along the first flow path 102 and the second flow path 106 between about 200 CFM and about 500 CFM.

Figure 3:
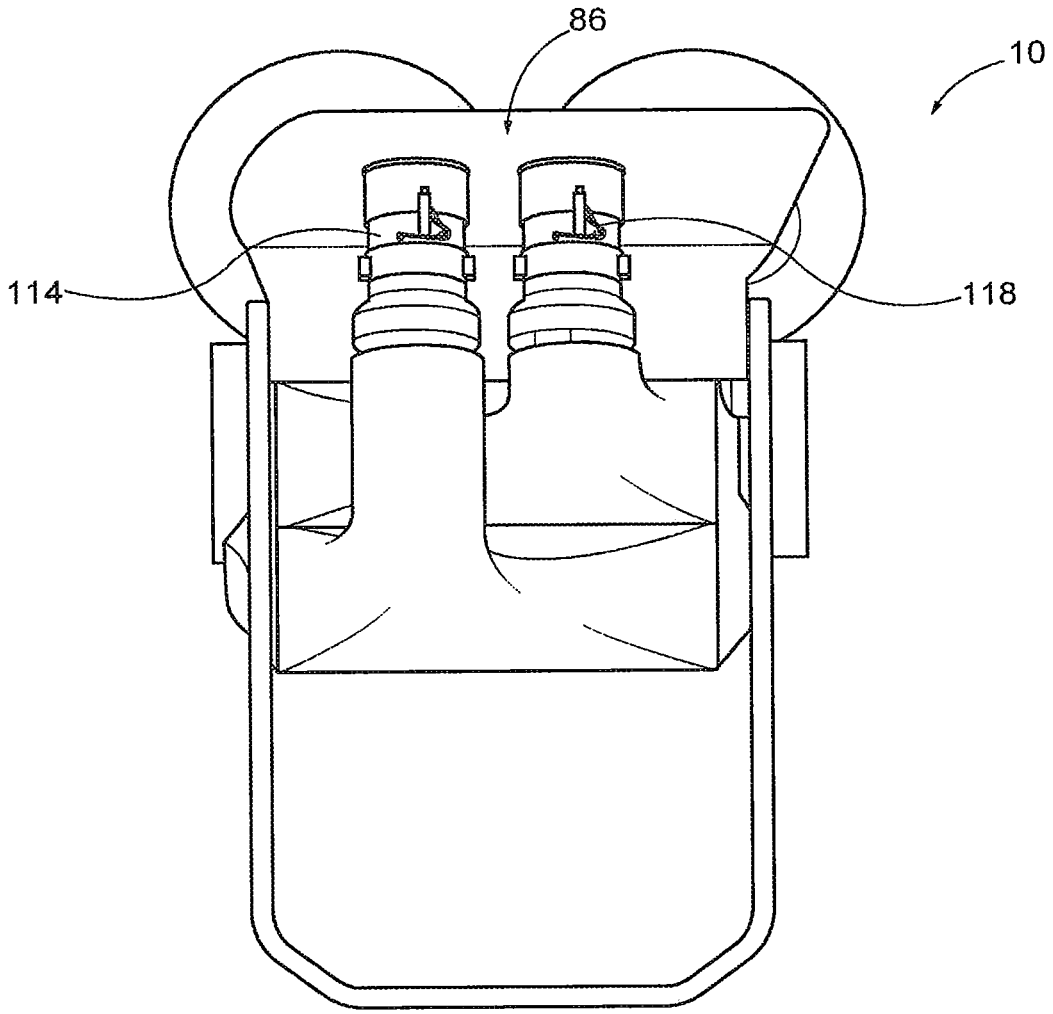
FIG. 3 is a top view of the floor cleaning machine of FIG. 2.

Referring to FIG. 3, in the illustrated embodiment, the suction source 86 includes a first vacuum motor 114 configured to generate airflow along the first flow path 102 and a second vacuum motor 118 configured to generate airflow along the second flow path 106. The vacuum motors may 114, 118 be controlled to independently vary the airflow rate along the first flow path 102 and the second flow path 106. In other embodiments, the suction source 86 may include a single vacuum motor configured to generate airflow along both the first flow path 102 and the second flow path 106. In such embodiments, one or more valves or dampers may be provided in one or both the first flow path 102 and the second flow path 106 to independently vary the airflow rate along the first flow path 102 and the second flow path 106. In some embodiments, the suction source 86 may not include a vacuum motor but instead may include one or more fans driven by the drive assembly 82.

Figure 5:
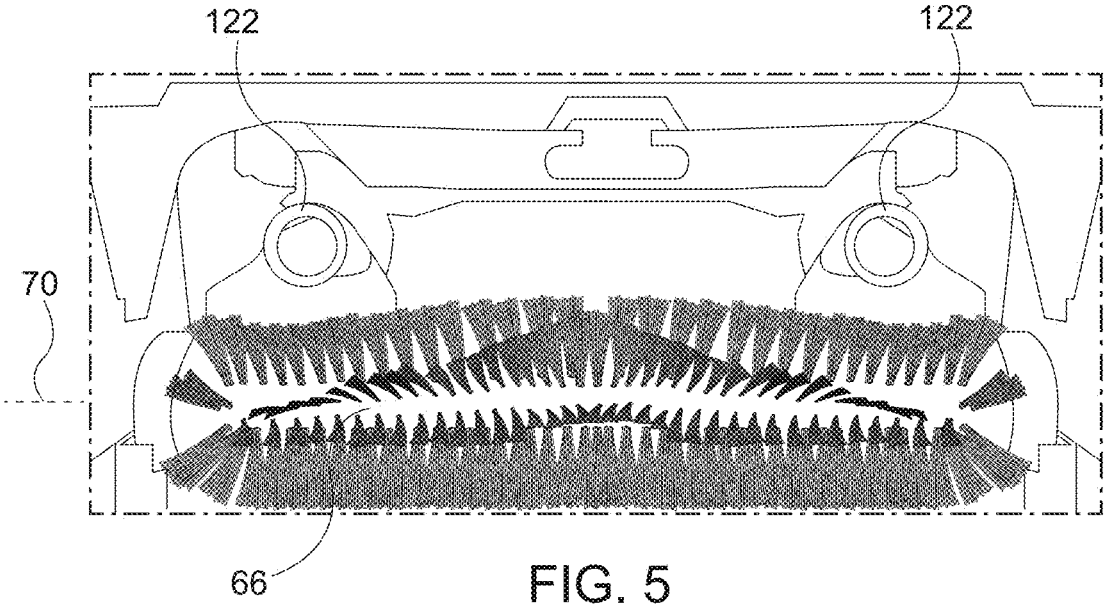
FIG. 5 is a perspective view of an underside of the floor cleaning machine of FIG. 1.

With reference to FIG. 5, the first flow path 102 includes first and second debris intake nozzles 122 that are positioned in the first suction zone 90. The intake nozzles 122 are positioned forward of the brushroll 66 and are spaced from one another in a direction parallel to the rotational axis 70 of the brushroll 66. The intake nozzles 122 are preferably located just above the bristles 46 of the rotary brushes 30*a*, 30*b* so as to intake dust shed by the rotary brushes 30*a*, 30*b*.

Figure 4:
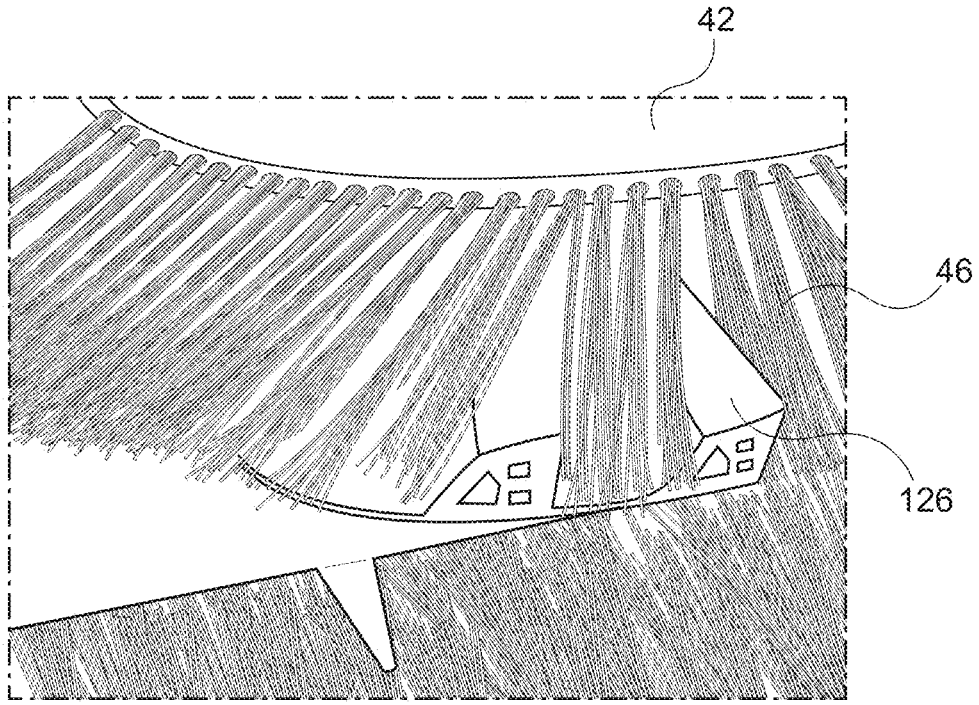
FIG. 4 illustrates a bristle agitation projection of the floor cleaning machine of FIG. 1.

As shown in FIGS. 2 and 4, projections 126 are provided in the travel path of the bristles 46 to engage and agitate the bristles 46 as they pass near the intake nozzles 122 in the first suction zone 90. In other embodiments, the first flow path 102 may include only a single intake nozzle 122 that may extend along the width of the housing 14, or more than two intake nozzles 122 may be used.

Figure 6:
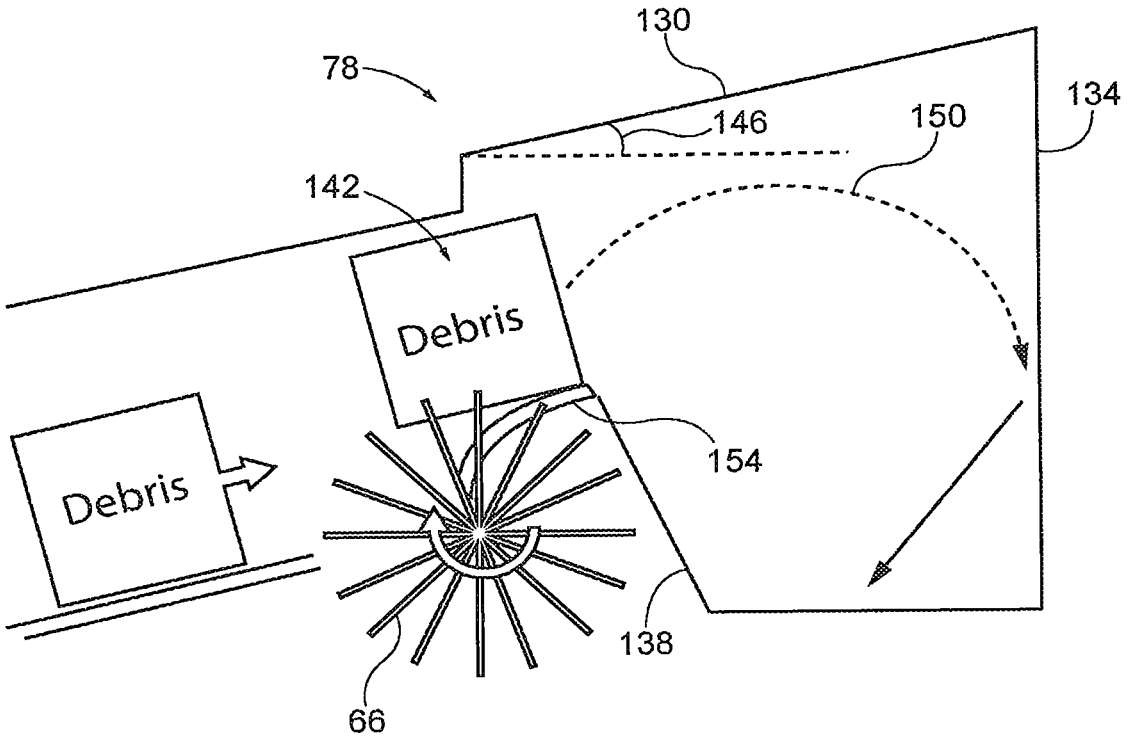
FIG. 6 illustrates a collection bin of the floor cleaning machine of FIG. 1.

Referring to FIG. 6, the collection bin 78 in the illustrated embodiment includes an upper wall 130, a rear wall 134, a front wall 138 generally opposite the rear wall 134, and an entry opening 142 in front wall. The upper wall 130 is angled upward at an oblique angle 146 such that a cross-sectional area of the collection bin 78 increases in a direction from the front wall 138 toward the rear wall 134. The angled upper wall 130 provides clearance for debris that is propelled by the brushroll 66 to pass into the collection bin 78 along an arcuate or generally parabolic trajectory 150. This advantageously reduces the likelihood that debris entering the collection bin 78 will jam together near the entry opening 142. In the illustrated embodiment, a comb 154 extends from the entry opening 142 into engagement with the rear side (i.e. the trailing side) of the brushroll 66. The comb 154 thus spans any gap between the front wall 138 of the collection bin 78 and the brushroll 66 to inhibit debris from accumulating between the brushroll 66 and the front wall 138. The comb 154 also engages the brushroll 66 as it rotates and may thus dislodge debris from the brushroll 66. The comb 154 is made of metal in some embodiments for strength and durability.

Figure 7B:
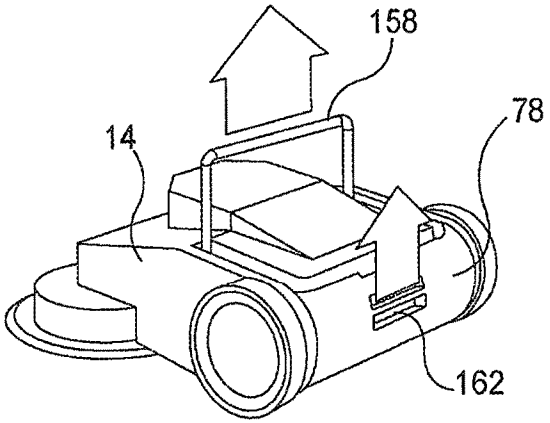
FIGS. 7A-7E illustrate removal and emptying of the collection bin of FIG. 6.
Figure 7A:
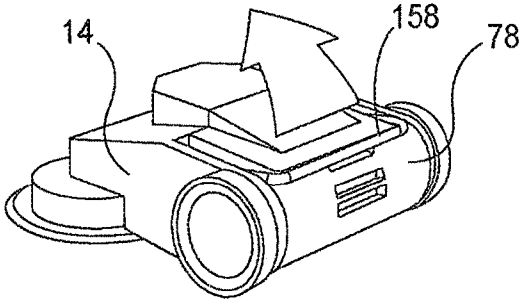
Figure 7E:
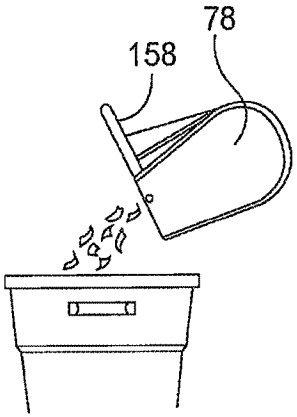
Figure 7D:
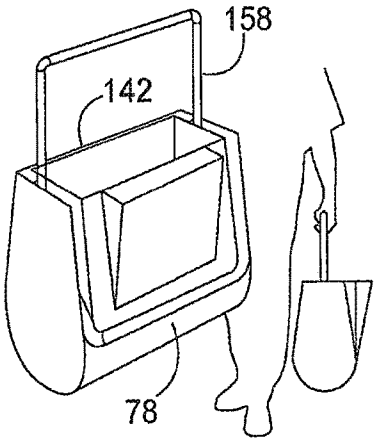
Figure 7C:
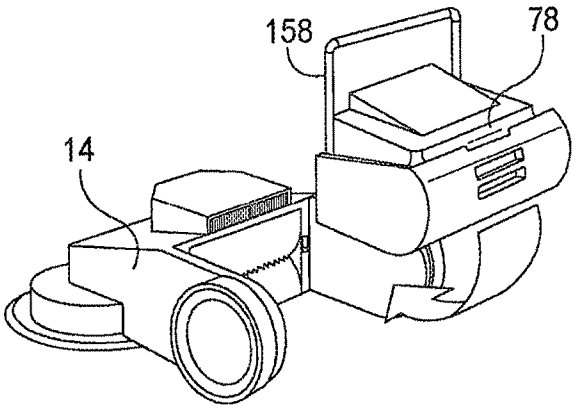

With reference to FIGS. 7A-E, the illustrated collection bin 78 includes a U-shaped first handle 158 pivotally coupled to the front of the collection bin 78 and a second handle 162 formed in the rear of the collection bin 78. To remove the collection bin 78 from the housing 14, a user pivots the first handle 158 up (FIG. 7A), then lifts up on the first and second handles 158, 162 simultaneously to free the collection bin 78 from the housing 14 (FIG. 7B). With the collection bin 78 free from the housing 14, the user can allow the weight of the collection bin 78 to pivot the collection bin 78 downward about the first handle 158 into a carrying position (FIGS. 7C and 7D). In the carrying position, the entry opening 142 of the collection bin 78 is oriented upward toward the first handle 158 so that debris is maintained in the collection bin 78 under the influence of gravity. The user can then empty the collection bin 78 as illustrated in FIG. 7E. After emptying the collection bin 78, the user can re-attach the collection bin 78 to the housing 14 by reversing the previous steps. In some embodiments, the collection bin 78 includes one or more transparent regions to permit a user to determine when the collection bin 78 should be emptied.

Figures 8A, 8B, 8C:
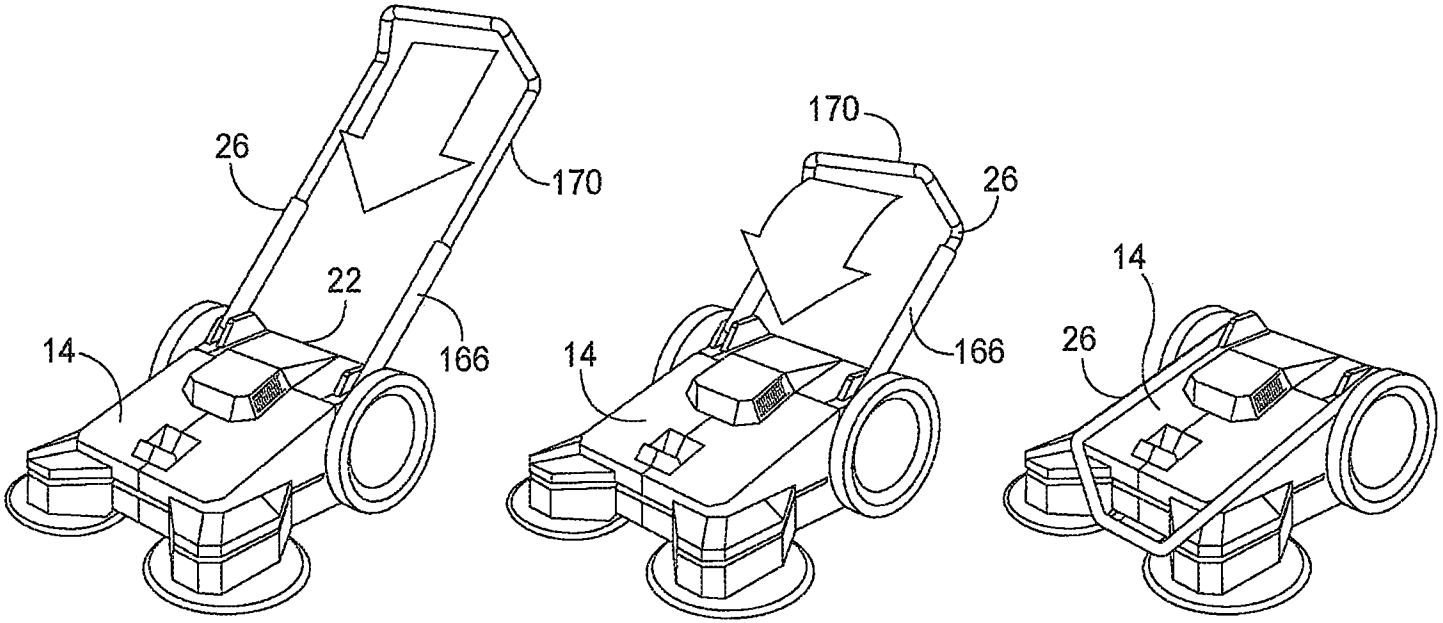
FIGS. 8A-8C illustrate movement of a handle of the floor cleaning machine of FIG. 1 between a deployed position and a storage position.
Figure 9:
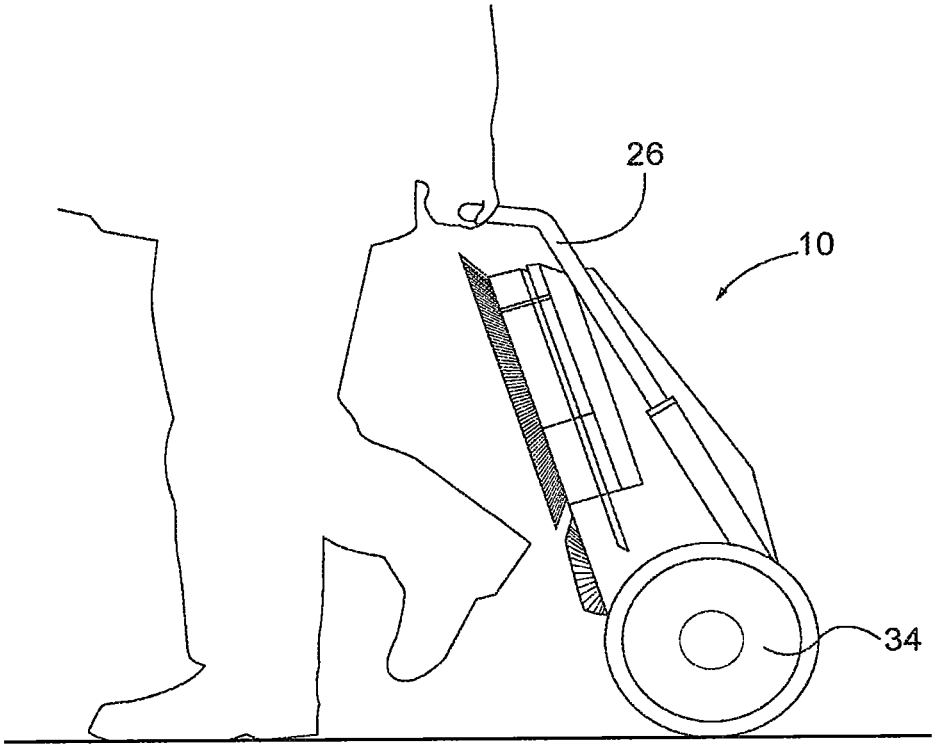
FIG. 9 illustrates the handle of the floor cleaning machine of FIG. 1 locked in the storage position for transport.

With reference to FIGS. 8A-C, in the illustrated embodiment, the handle 26 includes a first portion 166 pivotally coupled to the housing 14 and a second portion 170 that can telescope into and out of the first portion 166 to vary an overall length of the handle 26. The handle 26 is movable between a deployed position (FIG. 8A), in which the second portion 170 is fully extended from the first portion 166, and the handle 26 extends upward and rearward from the housing 14, and a storage position (FIG. 8C) in which the second portion 170 is fully inserted into the first portion 166 and the handle 26 is pivoted downward so as to overlie (i.e. extend along the top surface of) the housing 14. In some embodiments, the handle 26 can be locked in the storage position, allowing the machine 10 to be transported upright on the wheels 34 (FIG. 9). In some embodiments, controls (including, for example, one or more switches, buttons, dials, and the like) may be provided on the second portion 170 of the handle 26 for controlling operation of the machine 10. For example, the user may manipulate the controls to turn the suction source 86 on and off, vary the airflow rate along the first flow path 102 and the second flow path 106, turn the brushroll 66 and the brushes 30*a*, 30*b* on and off, and vary the speed of the brushroll 66 and the brushes 30*a*, 30*b* (FIG. 2).

Figure 10:
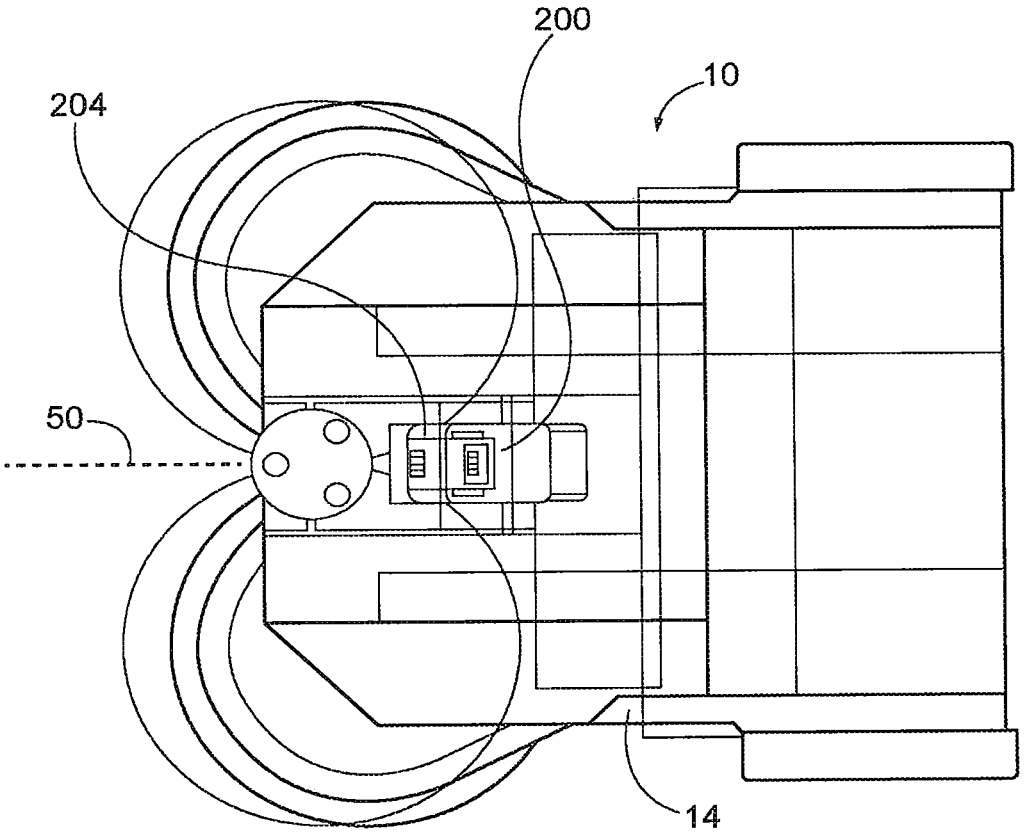
FIG. 10 is a top view of the floor cleaning machine of FIG. 1 configured for use with a battery.
Figure 11:
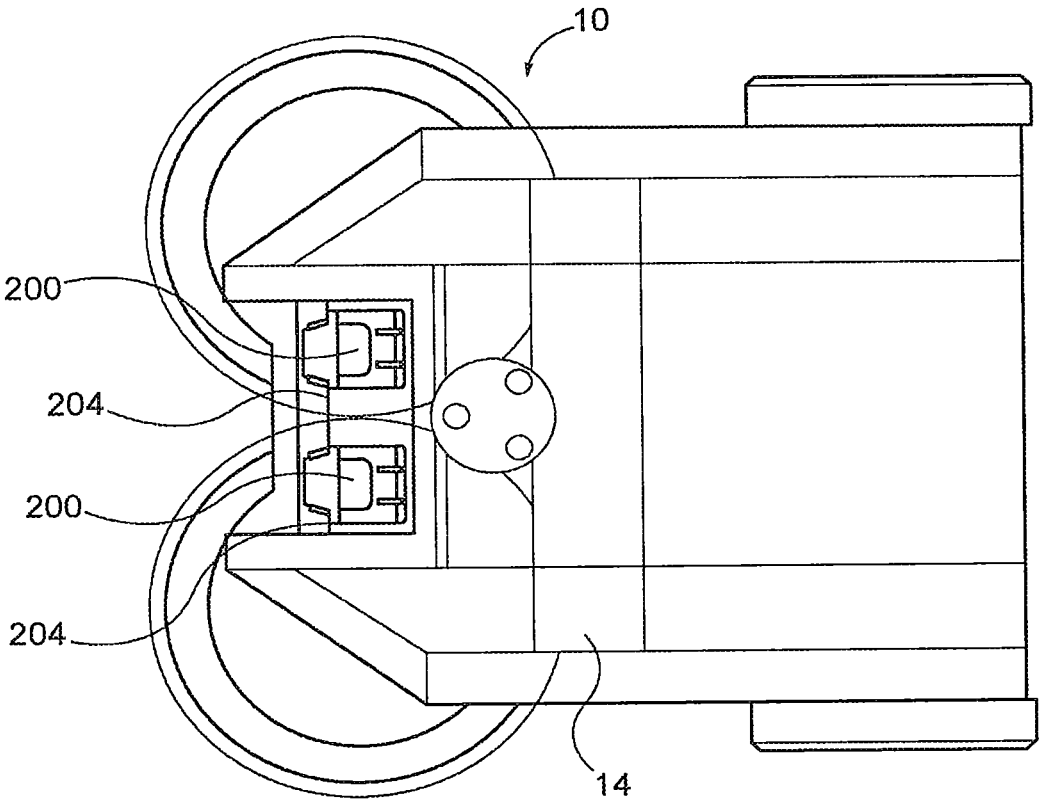
FIG. 11 is a top view of the floor cleaning machine of FIG. 1 configured for use with two batteries.
Figure 12:
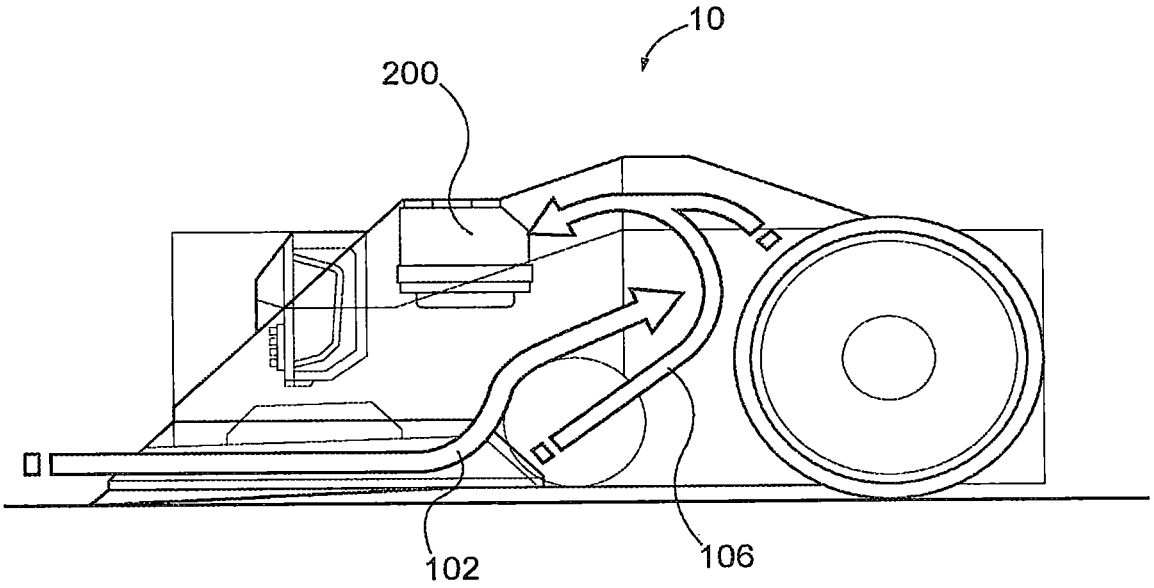
FIG. 12 illustrates cooling configuration for the battery of the floor cleaning machine of FIG. 10.

Referring to FIG. 10, the illustrated machine 10 further includes a battery 200 configured to provide power to the drive assembly 82 and the suction source 86. In some embodiments, the machine 10 is configured to draw a maximum power from the battery 200 during operation of less than 500 Watts. The battery 200 is removably coupled to a battery receptacle 204, which, in the illustrated embodiment is located on top of the housing 14 and centered along the axis 50. Alternatively, the battery 200 and receptacle 204 can be located elsewhere. The illustrated battery 200 is a power tool battery pack with a plurality of rechargeable battery cells (e.g., lithium-based battery cells; not shown) providing the battery 200 with a nominal output voltage of about 18V. In other embodiments, the battery 200 can have a different nominal voltage, such as, for example, 12V, 36V, or 40V. In another embodiment illustrated in FIG. 11, the machine 10 includes two batteries 200 disposed in adjacent battery receptacles 204. In such an embodiment, the batteries 200 may be connected in series or in parallel. In other embodiments, the machine 10 may include more than two batteries 200. Alternatively, the machine 10 may be configured to receive power from a wall outlet or other remote power source. With reference to FIG. 12, in some embodiments, at least a portion of the air flowing along the first flow path 102 and/or the second flow path 106 may be directed to cool the battery 200 (or batteries 200). For example, the suction source 86 may be configured to discharge air over the battery 200.

With reference to FIG. 2, in operation, a user grasps the handle 26 and pushes the machine 10 along a surface to be cleaned. The battery 200 powers the drive assembly 82, which drives the rotary brushes 30*a*, 30*b* and the brushroll 66. The rotary brushes 30*a*, 30*b* sweep dust and debris toward the inlet 54 (FIG. 1). After entering the housing 14, the dust and debris is swept up and rearward into the collection bin 78 by the brushroll 66 (FIG. 6). The angled upper surface 130 of the collection bin 78 allows the dust and debris to enter the collection bin 78 along an arcuate path 150 to avoid debris build up at the entry opening 142. Dust and debris that may cling to the bristles 46 of the brushes 30*a*, 30*b* is agitated off of the bristles 46 by the projections 126 (FIGS. 2 and 5) and can then be entrained in the first air flow path 102 via the inlet nozzles 122 or swept up by the brushroll 66. Dust and debris that may cling to the brushroll 66 is agitated off of the brushroll 66 by the comb 154. The negative pressure in the collection bin 78 due to the second suction zone 94 helps draw dust and debris into the collection bin 78. The user may manipulate the controls to turn the suction source 86 on and off, independently vary the airflow rate along the first flow path 102 and the second flow path 106, turn the brushroll 66 and the brushes 30*a*, 30*b* on and off, and vary the speed of the brushroll 66 and the brushes 30*a*, 30*b* to optimize cleaning performance.

In some embodiments, the machine 10 may also be used in a manual or unpowered mode (e.g., if the battery 200 is depleted or removed from the machine 10). In the manual mode, the brushroll 66 and the rotary brushes 30*a*, 30*b* are driven in response to rotation of the wheels 34 or other ground-engaging features as the user pushes the machine 10 along the surface to be cleaned. In the manual mode, the drive assembly 82 may be disconnected from the brushroll 66 and the brushes 30*a*, 30*b*.

Figure 13:
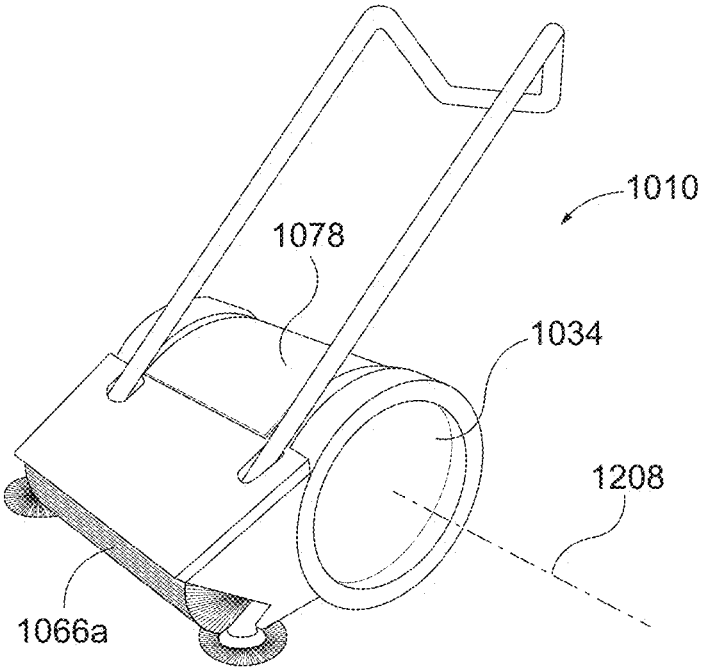
FIG. 13 is a perspective view of a floor cleaning machine according to another embodiment of the invention.
Figure 14:
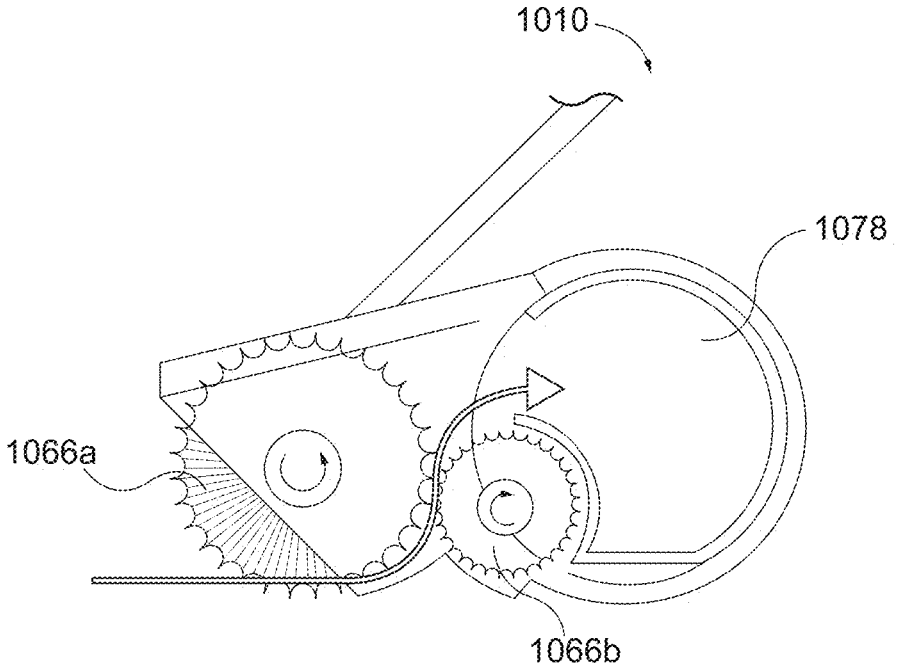
FIG. 14 is a cross-sectional view of the floor cleaning machine of FIG. 13.

FIGS. 13 and 14 illustrate a floor cleaning machine 1010 according to another embodiment. The floor cleaning machine 1010 is similar to the floor cleaning machine 10 described above with reference to FIGS. 1-12 but includes two brushrolls 1066*a*, 1066*b*, each rotating in opposite directions. In addition, the collection bin 1078 is disposed between the wheels 1034 and has a cylindrical shape defining a longitudinal axis 1208 that is coaxial with the rotational axis of the wheels 1034.

Although the invention has been described in detail with reference to certain preferred embodiments, variations and modifications exist within the scope and spirit of one or more independent aspects of the invention as described.

What is claimed is:

1. A floor cleaning machine comprising:

a housing having a front end and a rear end;

a rotary brush coupled to the housing for rotation with respect to the housing, the rotary brush rotatable about an axis angled relative to a surface to be cleaned;

a collection bin configured to receive debris from the rotary brush;

a brushroll coupled to the housing between the front end and the rear end for rotation with respect to the housing, the brushroll rotatable about an axis parallel relative the surface to be cleaned;

a debris intake in fluid communication with the collection bin, the debris intake including at least one nozzle located forward of the brushroll and above bristles of the rotary brush;

a motor that rotates the rotary brush;

a power source that supplies power to the motor;

a suction source in fluid communication with the collection bin, the suction source configured to draw debris into the debris intake and to direct the debris into the collection bin;

a projection positioned adjacent the rotary brush and the debris intake, the projection engages bristles of the rotary brush to dislodge dust or debris from the bristles such that the suction source is configured to draw dust or debris dislodged from the bristles of the rotary brush into the debris intake;

wherein the rotary brush is configured to sweep up debris into the collection bin;

wherein the projection is positioned relative the rotary brush such that the debris swept up from the rotary brush is propelled into the collection bin without being dislodged from the rotary brush by the projection; and wherein the collection bin receives both the debris swept up from the rotary brush and the dust or debris dislodged by the projection.

2. The floor cleaning machine of claim 1, wherein the rotary brush is a first rotary brush, further comprising a second rotary brush coupled to the housing for rotation with respect to the housing, wherein the debris intake includes a first debris intake nozzle positioned adjacent the first rotary brush and a second debris intake nozzle positioned adjacent the second rotary brush.

3. The floor cleaning machine of claim 1, wherein the axis extends at an oblique angle with respect to the surface to be cleaned, and wherein the projection is positioned between the bristles of the rotary brush and the surface to be cleaned.

4. The floor cleaning machine of claim 3, wherein the bristles of the rotary brush define a travel path and wherein the proj ection is positioned within the travel path of the bristles of the rotary brush to agitate the bristles and thereby dislodge debris from the bristles.

5. The floor cleaning machine of claim 4, wherein a front portion of the travel path of the rotary brush is positioned proximate the front portion of the housing and a rear portion of the travel path of the rotary brush is positioned between the front portion of the housing and the rear portion of the housing, wherein the front portion of the travel path of the rotary brush engages the surface to be cleaned and the rear portion of the travel path of the rotary brush is spaced from the surface to be cleaned, and wherein the projection is positioned to engage bristles in the rear portion of the travel path of the rotary brush.

6. The floor cleaning machine of claim 1, wherein the brushroll is rotated at a speed greater than 440 rotations per minute.

7. The floor cleaning machine of claim 6, wherein the rotary brush axis extends forwardly at an oblique angle with respect to the surface to be cleaned.

8. The floor cleaning machine of claim 7, further comprising an entry opening defined in the collection bin and a comb positioned adjacent the entry opening of the collection bin, the comb positioned to engage the brushroll to dislodge debris from the brushroll and to direct the dislodged debris into the entry opening of the collection bin.

9. The floor cleaning machine of claim 1 further comprising a wheel coupled to the housing, the wheel configured to facilitate moving the machine along a surface to be cleaned;

wherein the collection bin includes a front wall positioned between the front end of the housing and the rear end of the housing, the front wall defining an entry opening, a rear wall positioned adjacent the rear end of the housing, and an upper wall extending between the front wall and the rear wall, the upper wall being oriented at an oblique angle with respect to the surface being cleaned, such that a cross-sectional area of the collection bin increases in a direction from the entry opening in the front wall toward the rear wall, wherein the debris intake is in fluid communication with the entry opening in the front wall of the collection bin, and wherein the suction source is configured to draw debris into the debris intake and direct the debris into the collection bin, such that debris directed into the entry opening in the front wall of the collection bin is directed along the oblique upper wall toward the rear wall.

10. The floor cleaning machine of claim 9, wherein the brushroll is configured to direct debris into the entry opening in the front wall of the collection bin.

11. The floor cleaning machine of claim 10, further comprising a comb positioned adjacent the entry opening of the collection bin, the comb positioned to engage the brushroll to dislodge debris from the brushroll and to direct the dislodged debris into the entry opening of the collection bin.

12. The floor cleaning machine of claim 10, wherein the brushroll is rotated at a speed greater than 440 rotations per minute.

13. The floor cleaning machine of claim 9, further comprising a first handle pivotably coupled to the rear end of the housing, and a second handle pivotably coupled to the collection bin, the first handle engageable by the user to move the floor cleaning machine and the second handle engageable by the user to remove the collection bin from the housing.

14. The floor cleaning machine of claim 13, the second handle being rotatably coupled to the collection bin adjacent the front wall, the collection bin further comprising a third handle positioned adjacent the rear wall of the collection bin, the second handle and the third handle being configured to be grasped by the user to facilitate removal of the collection bin from the housing.

15. The floor cleaning machine of claim 1 wherein the suction source is a first suction source and further comprising a second suction source configured to draw air from the collection bin to create a negative pressure in the collection bin to move the debris drawn through the debris intake by the first suction source into the collection bin in response to the negative pressure in the collection bin created by the second suction source.

16. The floor cleaning machine of claim 15, further comprising a filter, wherein the first suction source includes a first vacuum motor that draws air and debris through the debris intake toward the filter, wherein the second suction source includes a second vacuum motor that draws air from the collection bin toward the filter to create a negative pressure in the collection bin, and wherein the negative pressure in the collection bin draws debris from the debris intake into the collection bin.

17. The floor cleaning machine of claim 16, wherein the first suction source generates a first suction zone proximate the rotary brush and the debris intake, and the second suction source generates a second suction zone in the collection bin.

18. The floor cleaning machine of claim 17, wherein the brushroll is configured to engage the surface to be cleaned and to direct debris toward the collection bin.

19. The floor cleaning machine of claim 18, further comprising a comb positioned adjacent an entry opening of the collection bin, the comb configured to engage the brushroll and to direct debris from the brushroll into the entry opening of the collection bin.

20. The floor cleaning machine of claim 18, wherein the brushroll is rotated at a speed greater than 440 rotations per minute.

* * * * *